US009850646B2

(12) United States Patent
Mizoguchi et al.

(10) Patent No.: US 9,850,646 B2
(45) Date of Patent: Dec. 26, 2017

(54) FLUSH TOILET

(71) Applicant: TOTO LTD., Kitakyushu-shi, Fukuoka (JP)

(72) Inventors: Kazuyoshi Mizoguchi, Kitakyushu (JP); Satoshi Yamakawa, Kitakyushu (JP); Masaki Kitamura, Kitakyushu (JP); Shu Kashirajima, Kitakyushu (JP)

(73) Assignee: TOTO LTD., Kitakyushu-shi, Fukuoka (JP)

( * ) Notice: Subject to any disclaimer, the term of this patent is extended or adjusted under 35 U.S.C. 154(b) by 0 days.

(21) Appl. No.: 15/341,748

(22) Filed: Nov. 2, 2016

(65) Prior Publication Data

US 2017/0138034 A1 May 18, 2017

(30) Foreign Application Priority Data

Nov. 12, 2015 (JP) ..... 2015-221915

(51) Int. Cl.

| | |
|---|---|
| ***A47K 3/20*** | (2006.01) |
| ***E03D 9/08*** | (2006.01) |
| ***E03D 11/08*** | (2006.01) |
| *A47K 13/00* | (2006.01) |

(52) U.S. Cl.

CPC ..... *E03D 9/08* (2013.01); *E03D 11/08* (2013.01); *A47K 13/00* (2013.01)

(58) Field of Classification Search

CPC ..... E03D 9/08
USPC ..... 4/420–420.5
See application file for complete search history.

(56) References Cited

U.S. PATENT DOCUMENTS

| | | | | |
|---|---|---|---|---|
| 3,879,769 | A * | 4/1975 | Slawinski | E03D 9/08 4/447 |
| 4,581,779 | A * | 4/1986 | Matsui | E03D 9/08 4/420.1 |
| 5,279,001 | A * | 1/1994 | Vento | A47K 13/005 4/420.4 |
| 5,504,948 | A * | 4/1996 | Chandler | E03D 9/08 4/420.4 |
| 5,630,234 | A * | 5/1997 | Childs | E03D 9/08 4/420.4 |
| 5,647,069 | A * | 7/1997 | Han | E03D 9/08 4/420.2 |
| 6,192,527 | B1 * | 2/2001 | Paul | E03D 9/08 4/420.4 |

(Continued)

FOREIGN PATENT DOCUMENTS

| | | |
|---|---|---|
| JP | 2002-294841 A | 10/2002 |
| JP | 2007-255155 A | 10/2007 |
| JP | 2011-231472 A | 11/2011 |

*Primary Examiner* — Lori Baker
(74) *Attorney, Agent, or Firm* — Baker & Hostetler LLP

(57) ABSTRACT

A flush toilet includes: a bowl portion; a rim portion disposed on a top edge of the bowl portion; a spout portion for spouting flush water supplied from the water supply source to the bowl portion to form a circulating current; a discharge passage for discharging waste in the bowl portion, an inlet portion of the discharge passage being connected at the bottom of the bowl portion; a sanitary washing device disposed at a rear of the bowl portion, the sanitary washing device including a nozzle for spraying flush water toward a user positioned over the bowl portion; and a skirt portion disposed to respectively cover sides of both the bowl portion and the discharge passage.

9 Claims, 8 Drawing Sheets

(56) References Cited

U.S. PATENT DOCUMENTS

| | | | | |
|---|---|---|---|---|
| 6,321,396 | B1 * | 11/2001 | Vallejo | E03D 9/08 4/420.2 |
| 6,339,852 | B1 * | 1/2002 | Huang | E03D 9/08 4/420.4 |
| 6,397,406 | B1 * | 6/2002 | Moshkovich | E03D 9/08 4/420.4 |
| 6,675,399 | B1 * | 1/2004 | Tomita | E03D 3/00 4/420.2 |
| 8,418,277 | B2 * | 4/2013 | Okubo | E03D 5/01 4/332 |

* cited by examiner

FLUSH TOILET

FIELD OF THE INVENTION

The present invention relates to a flush toilet, and in particular a flush toilet flushed by flush water supplied from a water supply source to discharge waste.

DESCRIPTION OF RELATED ART

For some time, known flush toilets flushed by flush water supplied from a water supply source to discharge waste have included those which, as set forth in Patent Document 1 (Japanese Patent Unexamined Publication No. 2007-255155), for example, include a toilet body made of resin, installed on a bathroom floor, a private part of a human body washing device housed within the toilet body, and a toilet seat and toilet lid rotatably attached to the toilet body. Such flush toilet bodies include a bowl portion, a rim portion disposed on the top edge portion of this bowl portion, and a skirt portion forming an outer wall portion; this bowl portion, rim portion, and skirt portion are respectively separate molded parts, mutually integrated into a single piece by welding or the like.

Also, a retractable nozzle is disposed on the interior of the approximately box-shaped private part washing device; the tip portion of this nozzle discharges cold or warm water so that a user can cleanse his/her private part.

In addition, an opening portion is formed on the back end surface of the toilet body, and the private part washing device is projected from the toilet body exterior through this opening portion into the toilet body, to be attached at a predetermined position inside the toilet body.

Next, flush toilets are also known in which, as set forth in Patent Document 2 (Japanese Patent Unexamined Publication No. 2011-231472) a casing, with a private part washing device built into it, is disposed on the top surface of the toilet body at the rear side of the bowl portion, and the position of the top surface of the toilet body rises toward the rear side.

As described in Patent Document 3 (Japanese Patent Unexamined Publication No. 2002-294841), known flush toilets also include those with a direct connection to a municipal water line, whereby flush water supplied from this municipal water line is respectively supplied to a jet nozzle and to a rim nozzle to perform jet flushing and rim flushing. In such flush toilets, a valve unit is housed inside a housing chamber at the rear portion of the toilet body; the area from the rim top surface to the toilet body rear portion is formed continuously, so that the height position of the top surface of the rear portion of the toilet body is higher than the height position of the top surface of the rim.

However, in a conventional flush toilet set forth in the above-described Patent Document 1, the top edge portion of the skirt portion extends horizontally at a position which is a predetermined distance below the top surface of the rim portion, but the top surface of the private part washing device is positioned above the top edge portion of the skirt portion, and the side surface of the private part washing device is not completely covered by the side surface of the skirt portion, so a gap is formed between the side surface of the private part washing device and the side surface of the skirt portion.

This raises the problem that dirt can easily adhere to the gap between the side surface of the private part washing device and the side surface of the skirt portion, increasing the burden of cleaning and maintenance, etc. Additionally, when water reaches the outside of the skirt portion, it can intrude into the private part washing device from the top edge of the skirt portion, potentially causing problems such as breakage or malfunction of the private part washing device.

In addition, to perform maintenance on the private part washing device requires access to the private part washing device inside the toilet body, and since access is not easily available from the user side of the toilet body, there is also a significant work burden imposed.

In the conventional flush toilet set forth in the above-mentioned Patent Document 2, the casing into which the private part washing device is built is placed on the top surface of the toilet body on the rear side of the bowl portion and exposed, therefore dirt easily adheres to the casing itself, increasing the burden of cleaning and maintenance, with the additional problem that if water gets on the casing itself due to splashing out of flush water, it can cause breakage or malfunction of the private part washing device.

In addition, in the above-described conventional flush toilet set forth in Patent Document 3 an opening enabling communication between the exterior of the toilet body and the valve unit is formed on the wall surface portion of the toilet body in the left-to-right direction of the valve unit, and since both the left and right sides of the valve unit are exposed, dirt easily adheres to the valve unit, leading to the problem of increased cleaning and maintenance burden.

Also, when water reaches the outside of the toilet body, that water can intrude from the opening on the wall surface portion of the toilet body into the valve unit, potentially causing problems such as breakage or malfunction of the valve unit.

In addition, when performing maintenance on the valve unit, the work burden is increased because the valve unit must be accessed from the opening on the wall surface portion of the toilet body to the side of the valve unit, and access cannot be easily achieved by a user above the toilet body.

Recent years have seen a demand for ways to improve the exterior design characteristics of a toilet body by raising the perceived external appearance of structural integration between the toilet body skirt portion and the toilet lid when the toilet lid is covering the toilet seat, while also improving functionality and cleanability of the flush toilet.

BRIEF SUMMARY OF THE INVENTION

The present invention was thus undertaken to resolve the above-described problems with the conventional art, and has the object of providing a flush toilet capable of improving cleanability and maintenance characteristics while also improving design characteristics.

In order to achieve the above-described object, the present invention is a flush toilet for discharging waste with flush water supplied from a water supply source, comprising: a bowl portion; a rim portion disposed on a top edge of the bowl portion; a spout portion configured to spout flush water supplied from the water supply source to the bowl portion so as to form a circulating flow; a discharge passage for discharging waste in the bowl portion, the discharge passage including an inlet portion being connected at the bottom of the bowl portion; a sanitary washing device disposed at a rear of the bowl portion, the sanitary washing device including a nozzle which sprays the flush water toward a user positioned over the bowl portion; and a skirt portion configured to cover sides of both the bowl portion and the discharge passage; wherein the skirt portion is configured to project further upward than a top surface of the rim portion so that a side surface of the skirt portion backward than the bowl portion covers the sides of the sanitary washing device, and a top surface of the sanitary washing device is disposed on an upper portion of the skirt portion.

According to the invention described above, the fact that the side surface of the skirt portion on the rear side is formed to project above the top surface of the rim portion so as to cover the side of the sanitary washing device more than the bowl portion eliminates the gap between the sanitary washing device side surface and the skirt portion side surface, such that dirt can be prevented from adhering from this gap, and cleanability can be improved. Also, elimination of the gap between the sanitary washing device side surface and the skirt portion side surface means that water can be prevented from intruding from the gap into the sanitary washing device even when there is water on the outside of the skirt portion. In addition, the disposition of the top surface of the sanitary washing device on the upper portion of the skirt portion covering the side of the sanitary washing device enables maintenance characteristics to be improved, since access to the sanitary washing device is made easier from above (the user side) when performing maintenance on the sanitary washing device, for example. Further, the side surface of the skirt portion backward than the bowl portion is configured to project above the rim portion top surface so as to cover the side of the sanitary washing device, the appearance of structural integration of the exterior of the bowl portion, the rim portion, and the skirt portion can be raised, thereby improving design characteristics.

In the present invention, preferably, the flush toilet further comprises a seal member which is disposed between a bottom surface of the sanitary washing device and a top surface of a rear area of the rim portion.

According to the invention described above, by disposing a seal member between the bottom surface of the sanitary washing device and the top surface of the rear area of the rim portion, intrusion of water into the sanitary washing device can be prevented by the seal member.

In the present invention, preferably, a top surface of the skirt portion includes a horizontal portion formed essentially horizontally, and a projecting portion projecting upward so as to cover the side of the sanitary cleaning device from the back end of the horizontal portion; the rim portion is adhered to both the horizontal portion and the projecting portion on the top surface of the skirt portion.

According to the invention described above, the rim portion can be reliably adhered and affixed to the top surface of the skirt portion by being adhered to both the horizontal portion of the top surface of the skirt portion and to the projecting portion. Also, because the adhered part of the rim portion and the skirt portion can be made unobtrusive, the appearance of structural integration between the rim portion and the skirt portion can be improved, as can design characteristics.

In the present invention, preferably, the spout portion includes a spout port for spouting water rearward, the spout port being disposed near a midway portion in a front-to-back direction of the rim portion on one side in a left-to-right direction, and the projecting portion on the top surface of the skirt portion is configured to gradually project rearward from around the top surface of the rim portion near the spout port.

According to the invention described above, when flush water is spouted from the spout port rearward, this spouted flush water can be constrained from splashing outward in the rear area of the rim portion.

In the present invention, preferably, the nozzle of the sanitary washing device is positioned above the rear of the rim portion at a standby state prior to use, and a front end of the nozzle extends up to a predetermined position above the bowl portion so as to spray the flush water in a predetermined direction when in use; and wherein a height position of the top surface of the rear area of the rim portion is either set to a same height position as the top surface of the front area of the rim portion, or is set to a height position higher than the same height position, so that the nozzle in use does not submerge at near the same height position as the height position of the top surface of the bowl portion.

According to the invention described above, when in use the nozzle of the sanitary washing device can be made more easily extendable up to a predetermined position above the bowl portion without becoming submerged at the same height position as that of the top edge of the bowl portion. Failures or malfunctions of the sanitary washing device caused by submersion of the nozzle of the sanitary washing device in the bowl portion can be prevented.

In the present invention, preferably, the skirt portion has an outer circumferential surface which is configured to taper downward from around a midway portion in the up-down direction of the skirt portion.

According to the invention described above, a toilet assist member for carrying the flush toilet can be attached, for example, on the outer circumferential surface of the skirt portion, thereby facilitating carrying of the flush toilet.

In the present invention, preferably, the flush toilet further comprises a toilet seat placed so as to cover the sanitary washing device and the rim portion from above.

According to the invention described above, the placement of a toilet seat so as to cover the sanitary washing device and the rim portion from above enables the top surfaces of the sanitary washing device and the rim portion to be protected. Also, since the top surfaces of this sanitary washing device and rim portion can be hidden and kept unobtrusive, design characteristics can also be improved.

In the present invention, preferably, the flush toilet further comprises a toilet lid disposed to cover an entire of the toilet seat from above.

According to the invention described above, the toilet lid placed to cover the entire toilet seat from above enables protection of the toilet seat by covering it with a toilet lid when the flush toilet is not in use. Also, by covering the toilet seat with the toilet lid, the toilet seat and bowl portion can be hidden and kept unobtrusive, thereby improving design characteristics.

In the present invention, preferably, the skirt portion has an outer surface area which is set at 60% to 70% of a total surface area of both outer surface areas of the toilet lid and the skirt portion.

According to the invention described above, the majority of the flush toilet parts other than the toilet lid can be covered by the skirt portion, and the internal structure can be protected by the skirt portion. The skirt portion covering a majority of the flush toilet can improve the external appearance of structural integration of the flush toilet, thus improving design characteristics.

Using the present invention, cleanability and maintenance characteristic can be raised, and design characteristics improved.

DETAILED DESCRIPTION OF THE INVENTION

Hereafter, a flush toilet according to an embodiment of the present invention will be described with reference to FIGS. 1 to 8.

Figure 1:
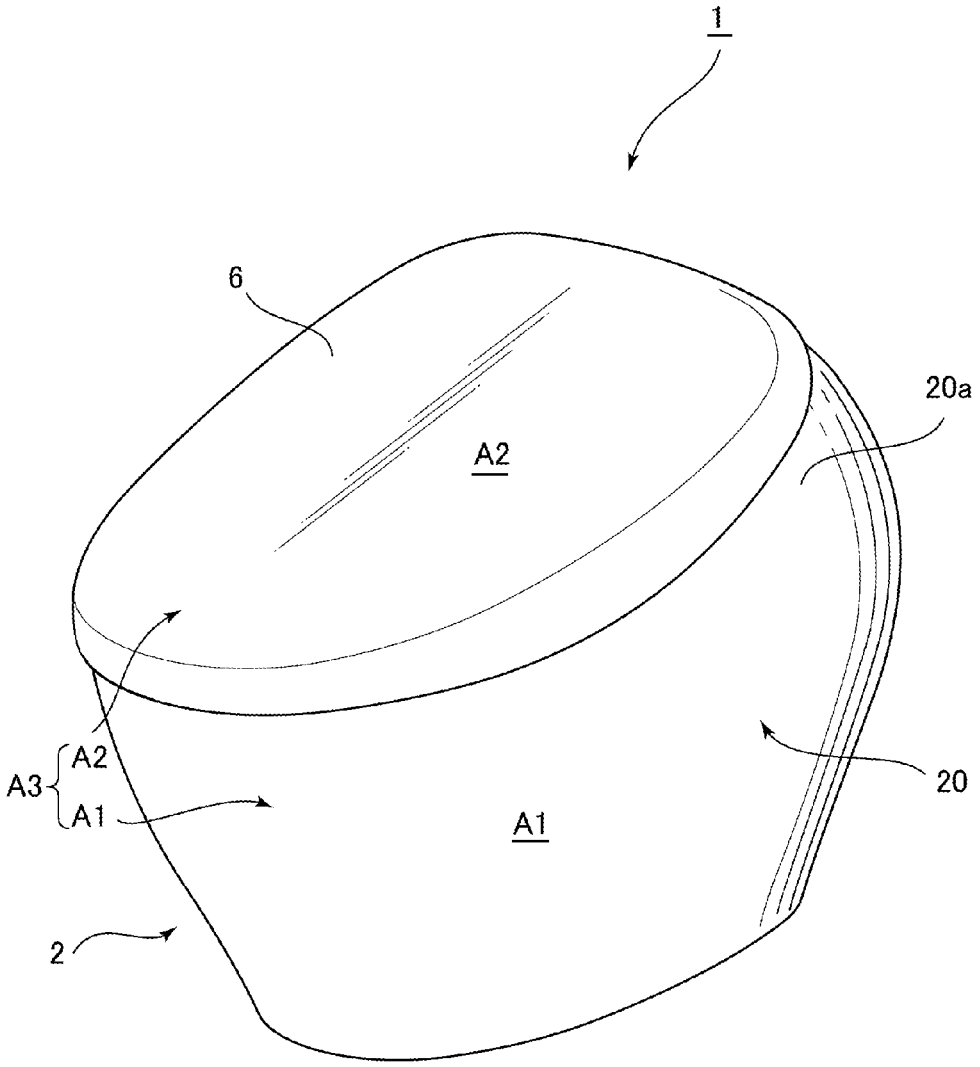
FIG. 1 is a perspective view showing a flush toilet according to a first embodiment of the invention; the state is shown in which the toilet lid is closed.
Figure 2:
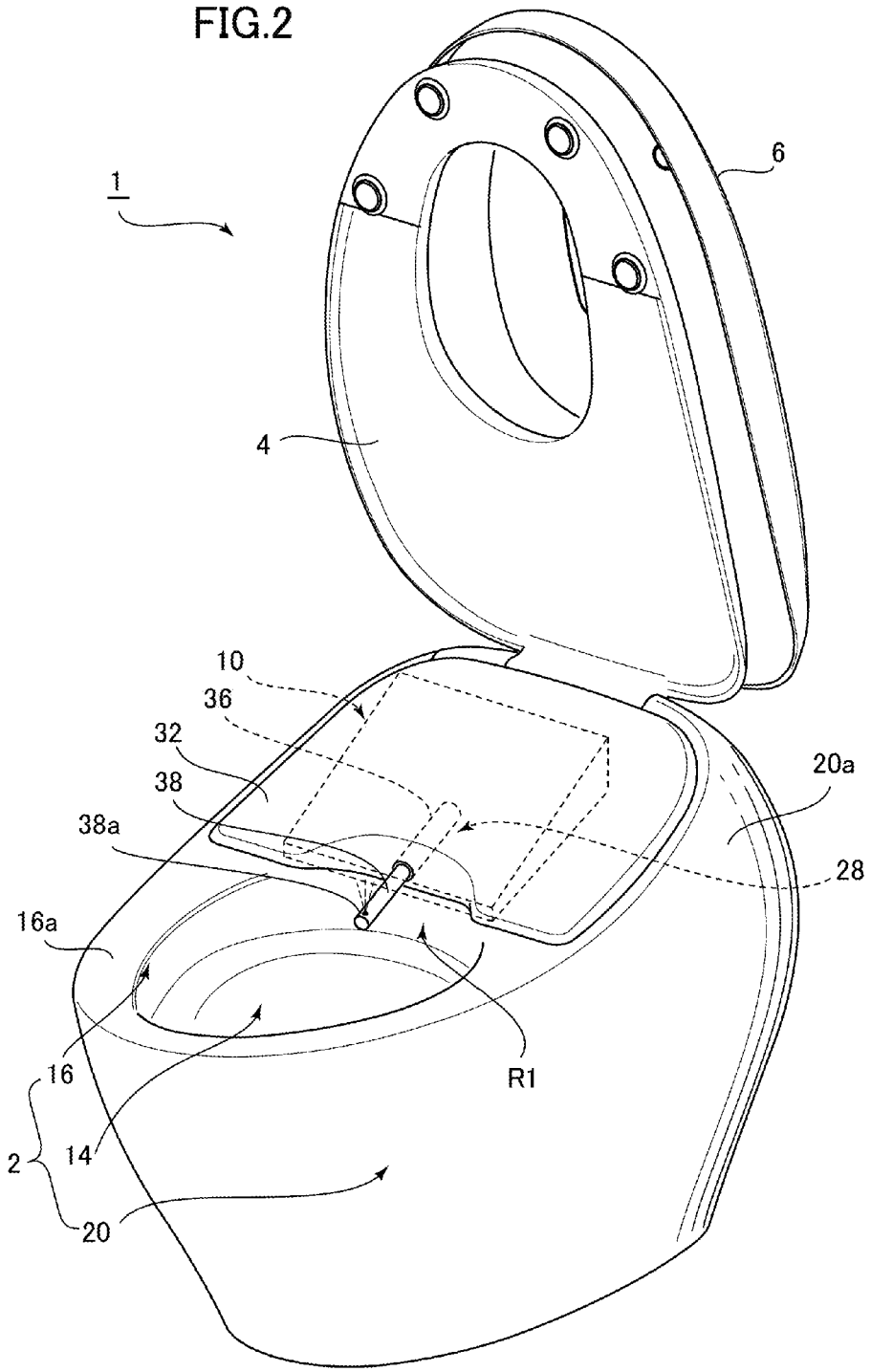
FIG. 2 is a perspective view showing a flush toilet according to an embodiment of the invention, showing the state in which the toilet seat and toilet lid have been rotated to an upper position relative to the toilet body.

First, FIG. 1 is a perspective view of a flush toilet according to an embodiment of the present invention, showing the toilet lid in a closed state; FIG. 2 is a perspective view of a flush toilet according to an embodiment of the present invention, showing the state in which a toilet seat and toilet lid is rotated to an upper position relative to the toilet body.

Figure 3:
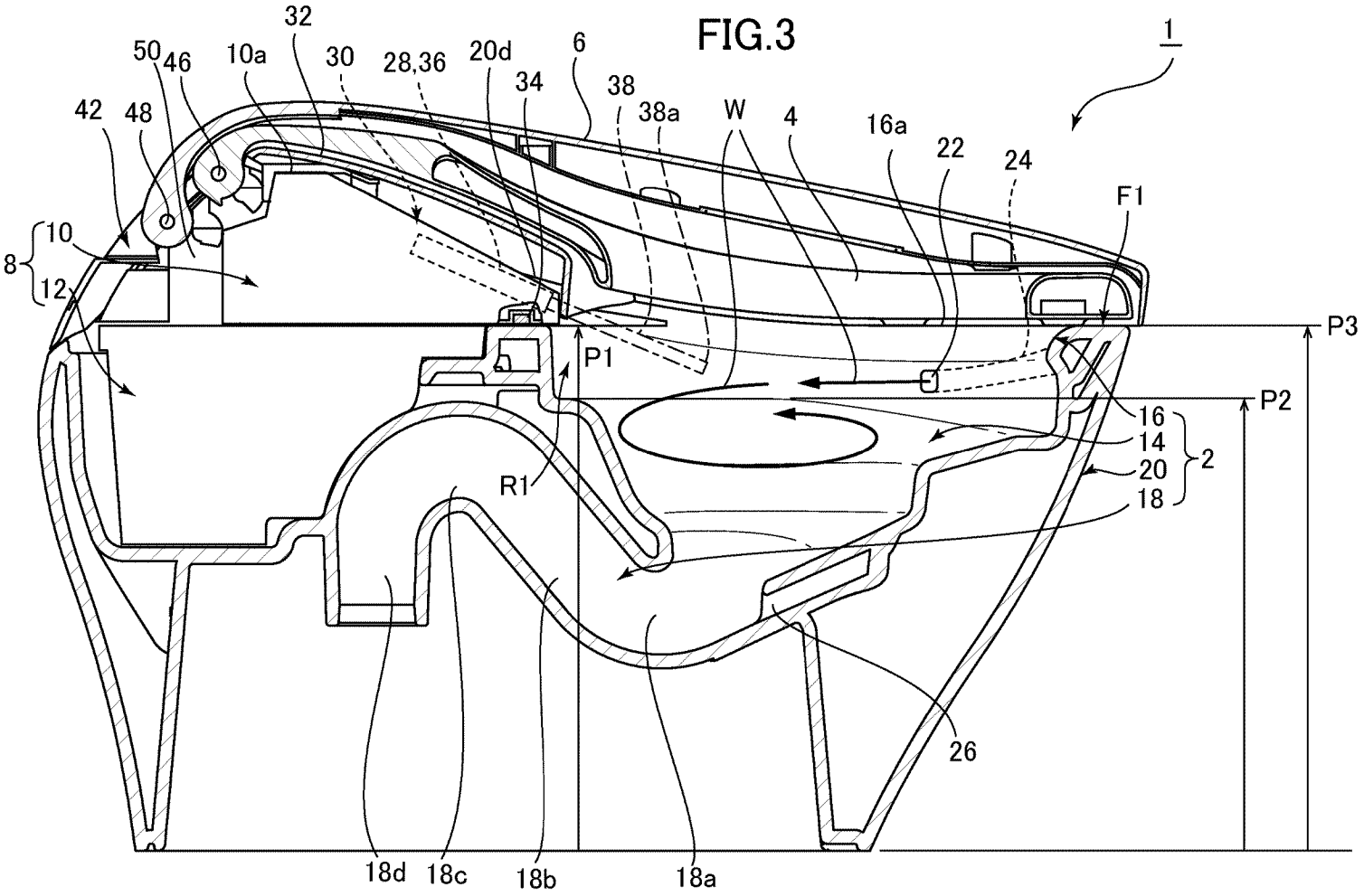
FIG. 3 is a cross sectional view seen from the left side of a center cross section in the left-to-right direction of a flush toilet according to the embodiment of the invention shown in FIG. 1.
Figure 4:
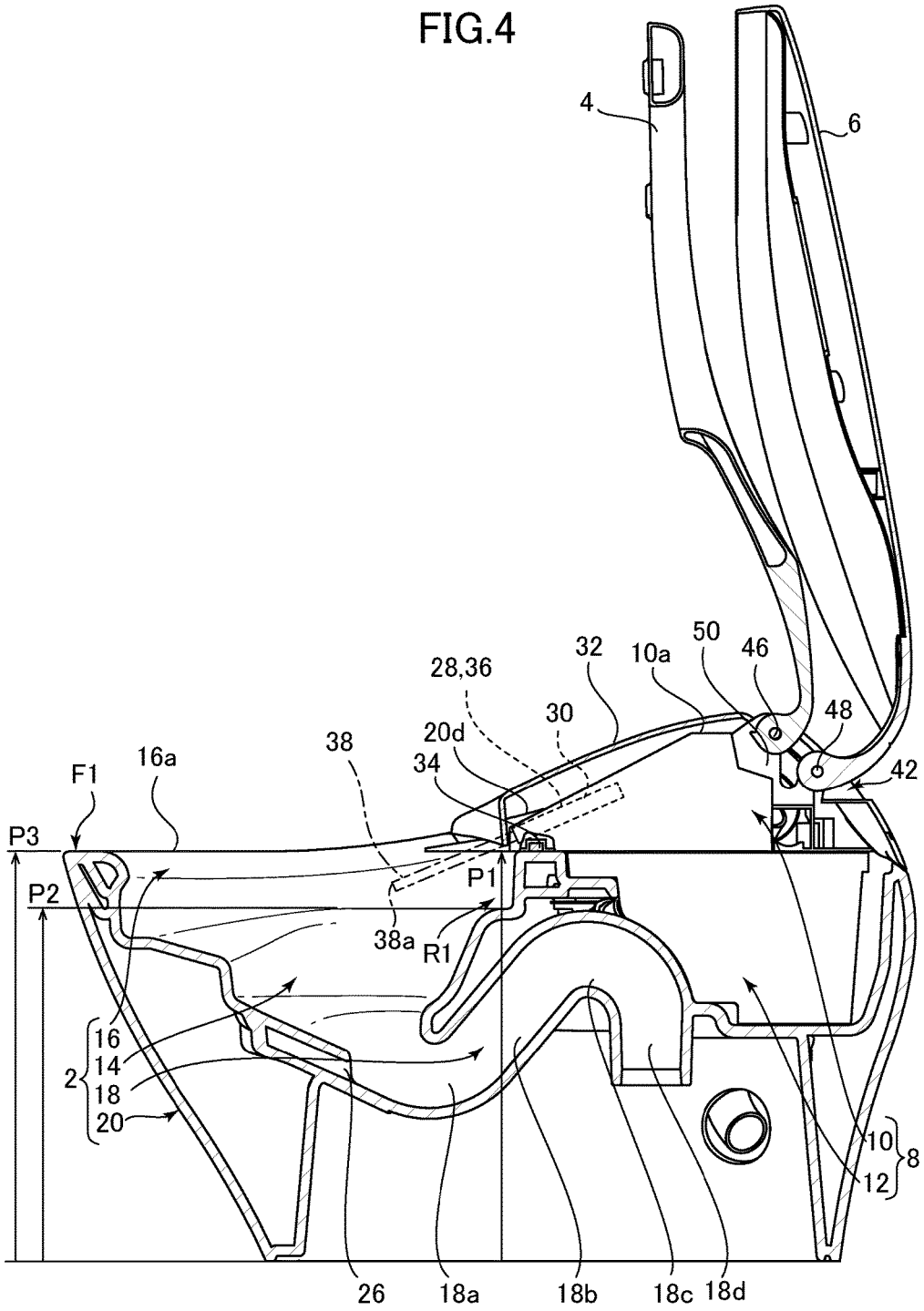
FIG. 4 is a cross sectional view seen from the right side of a center cross section in the left-to-right direction of a flush toilet according to the embodiment of the invention shown in FIG. 2.

FIG. 3 is a cross sectional view seen from the left side of a center cross section in the left-to-right direction of a flush toilet according to the embodiment of the invention shown in FIG. 1; FIG. 4 is a cross sectional view seen from the right side of a center cross section in the left-to-right direction of a flush toilet according to the embodiment of the invention shown in FIG. 2.

As shown in FIGS. 1-4, a flush toilet apparatus 1 according to an embodiment of the present invention includes: a ceramic toilet body 2, a toilet seat 4 disposed on the top surface of this toilet body 2 (details below), a toilet lid 6 disposed to cover this toilet seat 4 (details below), and a functional portion 8 disposed at the back of the toilet body 2.

As shown in FIGS. 3 and 4, the functional portion 8 includes: a sanitary washing system functional portion 10, disposed on the rear upper portion of the toilet body 2 and functioning as a sanitary washing device for washing the user's private part, and a water supply system functional portion 12, disposed close to this sanitary washing system functional portion 10 and pertains to the function of supplying water to the toilet body 2.

Figure 5:
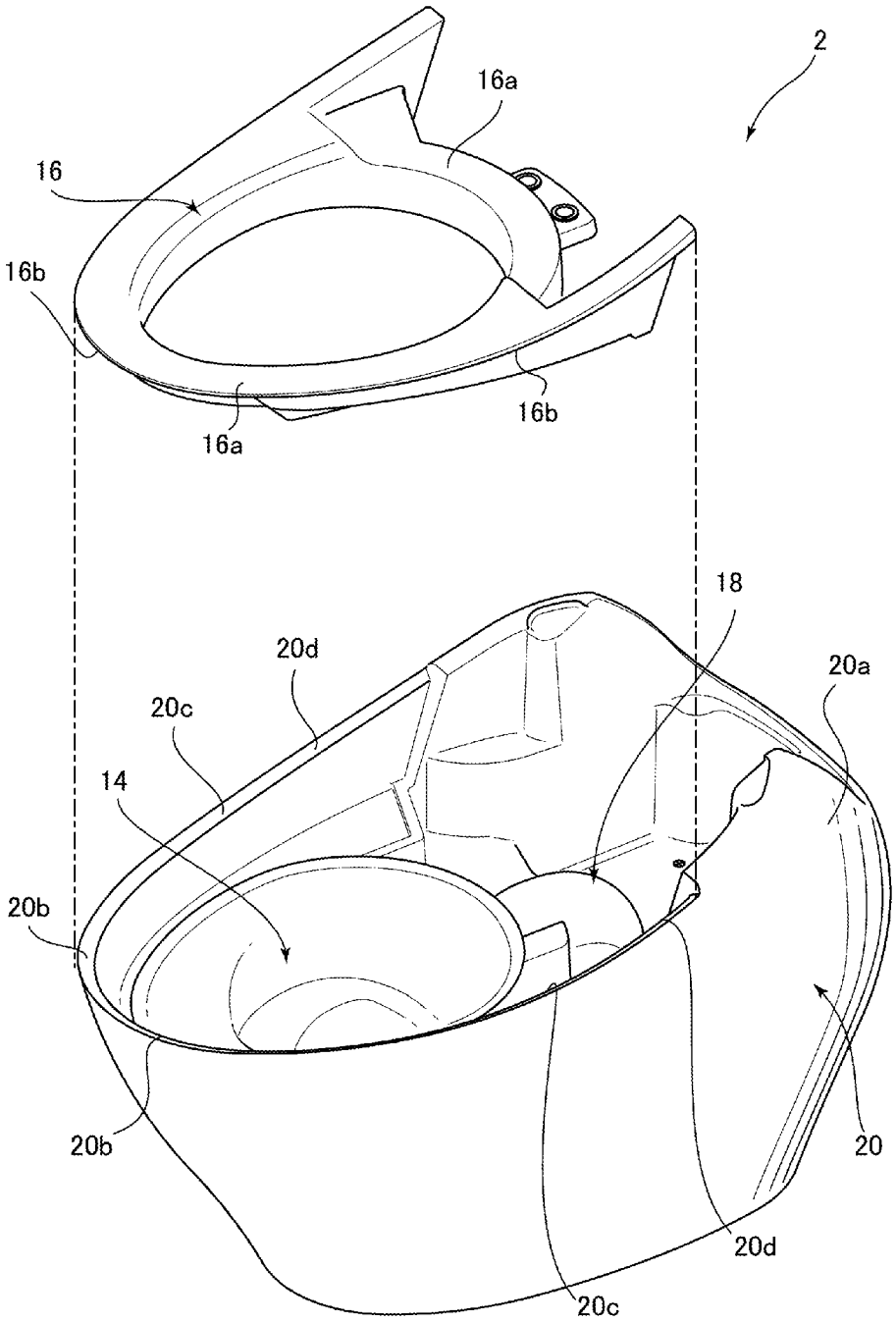
FIG. 5 is a perspective view of the toilet body in a flush toilet according to an embodiment of the present invention.

Next, FIG. 5 is a perspective view of the toilet body in a flush toilet according to an embodiment of the present invention.

As shown in FIGS. 2-5, the toilet body 2 includes: a rim portion 16 disposed on the top edge of this bowl portion 14; a discharge trap pipe 18, to which an inlet portion 18*a* is connected at the bottom of the bowl portion 14 and serves as discharge passage for discharging waste in the bowl portion 14; and a skirt portion 20 disposed to cover the bowl portion 14 and the discharge trap pipe 18 respectively from the side (details below).

As shown in FIG. 3, a rim spout port 22 (rim portion) is formed close to the midway portion in the front-to-back direction of the right area in the left-to-right direction of the inside circumferential portion of the rim portion 16; flush water is spouted along the edge of the bowl portion 14 toward the rear from this rim spout port 22, forming a circulating flow inside the bowl portion 14. Here, as shown in FIGS. 3 and 4, the upstream side of a water conduit 24 formed on the upstream side of the rim spout port 22 is directly connected to a municipal water line serving as water supply source (not shown), and flush water is discharged from the rim spout port 22 by the water supply pressure of this municipal water line (not shown).

Furthermore, as shown in FIGS. 3 and 4, a jet spout port 26 is formed at the bottom portion of the bowl portion 14, pointing toward the inlet portion 18*a* on the discharge trap pipe 18. With respect to spouting by this jet spout port 26, flush water stored in a reservoir tank (not shown) disposed on the water supply system functional portion 12 is pressurized by a pressurizing pump (not shown) in the water supply system functional portion 12 and discharged from the jet spout port 26. Flush water discharged from the jet spout port 26 flows into an ascending pipe 18*b* at the rear side of an inlet portion 18*a* from the inlet portion 18*a* of the discharge trap pipe 18, then flows through this ascending pipe 18*b* and out to a descending pipe 18*d*, from the peak portion 18*c* of the discharge trap pipe 18.

Next, regarding the specific structures of the sanitary washing system functional portion 10 and the water supply system functional portion 12, respectively, these are the same as in the past, so here a detailed explanation thereof is omitted, but as shown in FIGS. 3 and 4, a private part washing device 30 including a nozzle apparatus 28 (nozzle) for spraying cleansing water toward a user sitting over the bowl portion 14 is disposed on the sanitary washing system functional portion 10. In addition, a reservoir tank for storing cleansing water supplied to the washing device 30 (not shown), a heater for heating cleansing water in this reservoir tank (not shown) to produce warm water, a circulating fan (not shown), an odor venting fan (not shown), a warm air fan (not shown), and a controller (not shown) for controlling the operation of these devices are disposed on the sanitary washing system functional portion 10.

At the same time, the upstream side of the water supply system functional portion 12 water supply path (not shown) is connected to a municipal water line (not shown), and items such as a fixed flow valve (not shown), an electromagnetic valve (not shown), and a switching valve (not shown) for switching between supplying water to a reservoir tank (not shown) and spouting water to the rim spout port 22 are disposed on the upstream side water supply path to the reservoir tank (not shown). Additionally, a controller (not shown) is disposed on the water supply system functional portion 12 for controlling the opening and closing operation of the electromagnetic valve (not shown), the switching operation of the switching valve (not shown), and the rpm and operating time, etc. of the pressurizing pump (not shown).

Note that with respect to the flush toilet apparatus 1 according to the present embodiment, a so-called hybrid type of flush toilet is explained, whereby rim spouting by the rim spout port 22 is carried out using municipal water supply pressure, and for jet spouting by the jet spout port 26, flush water inside a reservoir tank (not shown) is supplied by controlling a pressurizing pump (not shown), but the invention is not limited to this form, and may be applied to other forms. I.e., other acceptable forms include a form whereby, for flush water directly supplied from only a municipal water line, switching between rim spouting by the rim spout port 22 and jet spouting by the jet spout port 26 is effected by switching a valve, and a form whereby for flush water in a reservoir tank, switching between rim spouting by the rim spout port 22 and jet spouting by the jet spout port 26 is effected by switching only a pump.

Hereafter, referring to FIGS. 1-8, details of the rim portion 16 and skirt portion 20, as well as the toilet seat 4 and toilet lid 6, in the toilet body 2 of the flush toilet apparatus 1 of the present embodiment are explained.

Figure 6:
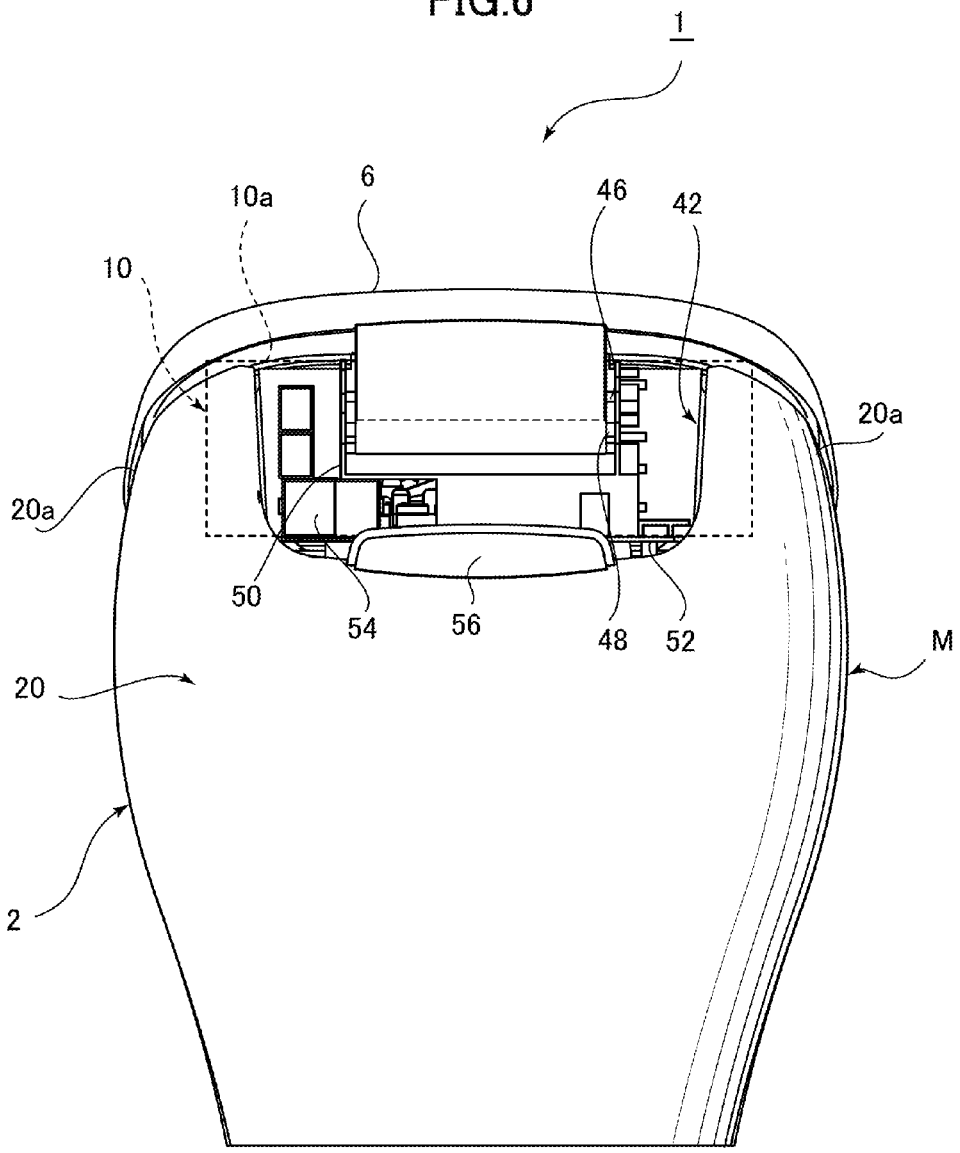
FIG. 6 is a rear elevation of the toilet body in a flush toilet according to an embodiment of the present invention.

FIG. 6 is a rear elevation of the toilet body in a flush toilet according to an embodiment of the present invention.

As shown in FIGS. 1-6, the skirt portion 20 of the toilet body 2 is formed so that the side surface 20*a*, which is further to the rear than the bowl portion 14, projects further upward than the top surface 16*a* of the rim portion 16, so as to cover both sides of the sanitary washing system functional portion 10 in the left-to-right direction, and the sanitary washing system functional portion 10 top-most surface 10*a* is disposed on the upper portion of the skirt portion 20. A cover member 32 is removably attached from above to the top of the sanitary washing system functional portion 10.

This eliminates the gap between the side surface of the sanitary washing system functional portion 10 and the inside surface of the skirt portion 20 opposing it, so that dirt from this gap can be prevented from adhering, and cleanability can be improved.

Also, the elimination of the gap between the side surface of the sanitary washing system functional portion 10 and the inside surface of the skirt portion 20 opposing it means that water can be prevented from intruding into the sanitary washing system functional portion 10 from the gap even when there is water on the outside of the skirt portion 20.

Furthermore, because the top-most surface 10*a* of the sanitary washing system functional portion 10 is disposed on the upper portion of the skirt portion 20, and the cover member 32 is removably attached to the top of the sanitary washing system functional portion 10 from above, access to the sanitary washing system functional portion 10 from above (the user side) is made easier when performing maintenance or the like on the washing device 30 of the sanitary washing system functional portion 10 or other equipment, for example, therefore maintenance characteristics can be improved.

By forming the side surface 20*a* of the skirt portion 20, which is further to the rear than the bowl portion 14, so that it projects further upward than the top surface 16*a* of the rim portion 16 so as to cover both sides in the left-to-right direction of the sanitary washing system functional portion 10, and so that it tapers inwardly, the external appearance of structural integration between the bowl portion 14 and the rim portion 16 and skirt portion 20 can be raised, and design characteristics improved.

Next, as shown in FIGS. 3-5, a seal member 34 is disposed between the bottom surface of the sanitary washing system functional portion 10 and the top surface 16*a* of the rear area of the rim portion 16. Thus the seal member 34 can prevent intrusion of water into the sanitary washing system functional portion 10 even if, for example, flush water in the bowl portion 14 intrudes between the top surface 16*a* at the rear area of the rim portion 16 and the bottom surface of the sanitary washing system functional portion 10.

Next, as shown in FIGS. 3-5, the top surface of the skirt portion 20 includes a horizontal portion 20*b* formed essentially parallel thereto, and a projecting portion 20*d* which projects upward from the back end 20*c* of this horizontal portion 20*b* so as to cover the side of the sanitary washing device.

Also, as shown in FIG. 5, the bottom surface 16*b* on the outer edge portion of the rim portion 16 is adhered in the toilet body 2 manufacturing process to both the horizontal portion 20*b* and the projecting portion 20*d* at the top surface of the skirt portion 20. This enables the rim portion 16 to be reliably adhered and affixed to the top surface of the skirt portion 20. Since the adhered part of the rim portion 16 and the skirt portion 20 can be made unobtrusive, the appearance of structural integration between the rim portion 16 and the skirt portion 20 can be improved, as can design characteristics.

Next, as shown in FIG. 3, the rim spout port 22 is formed close to the midway portion in the front-to-back direction of the inside perimeter surface of the rim portion 16 on one side in the left-to-right direction of the toilet body 2 (the right side in the left-to-right direction of toilet body 2), so that flush water directed to the rim spout port 22 through the water conduit 24 from a municipal water line (not shown) serving as water supply source is spouted rearward.

Also, as shown in FIGS. 3 and 5, the projecting portion 20*d* of the top surface of the skirt portion 20 close to the top surface 16*a* of the rim portion 16 near the rim spout port 22, and on both the left and right sides further to the rear thereof, is formed to gradually project upward toward the rear starting near the top surface 16*a* of rim portion 16 close to the rim spout port 22, and when flush water W is spouted toward the rear from the rim spout port 22, this spouted flush water W can be constrained from splashing outward in the area at the rear side of the rim portion 16.

Next, as shown in FIGS. 2-4, in the nozzle apparatus 28 of the washing device 30 on the sanitary washing system functional portion 10, the nozzle body 36 in the standby state prior to use is positioned above the rear area R1 of the rim portion 16, and the tip portion 38*a* of the nozzle body 38 in use extends up to a predetermined position above the bowl portion 14 to spray cleansing water in a predetermined direction toward a user on the toilet seat 4.

As shown in FIGS. 2-4, the height position P1 of the top surface of the rear area R1 of rim portion 16 is set to the same height position as the height position P3 of the top surface of the front area F1 of the rim portion 16, so that the tip portion 38*a* of the nozzle body 38 in use is not submerged close to the same height position as the height position P2 of the top edge of the bowl portion 14.

Note that the height position P1 of the top surface of the rear area R1 of the rim portion 16 may also be set to a position higher than the height position P3 of the top surface of the front area F1 of the rim portion 16.

By so doing, the nozzle body 38 of the nozzle apparatus 28 in the washing device 30 in use can be easily extended to a predetermined position above the bowl portion 14 without the tip portion 38*a* thereof being submerged near the same height position as the height position P2 of the top edge of the bowl portion 14.

Also, a failure or malfunction of the washing device 30 caused by submersion in the bowl portion 14 of the nozzle body 38 on the nozzle apparatus 28 of the washing device 30 during use can be prevented.

Next, as shown in FIG. 6, the skirt portion 20 is formed so that its outer circumferential surface tapers downward from around the up-down direction midway area M. Thus a toilet assist member 40 for carrying the flush toilet apparatus 1 can be attached, for example, to the part where the outer circumferential surface of the skirt portion 20 has a tapered shape, thereby facilitating carrying of the flush toilet apparatus 1.

Figure 7:
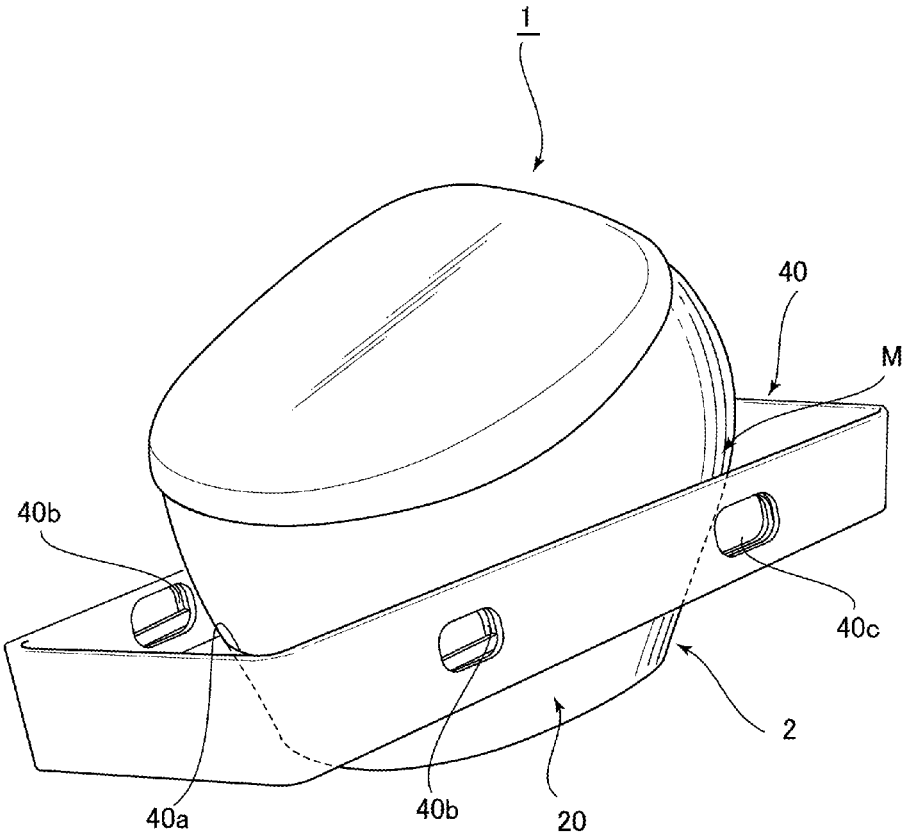
FIG. 7 is a perspective view in which a toilet assist member is attached to a flush toilet according to an embodiment of the invention.

Here FIG. 7 is a perspective view of a state in which a toilet assist member is attached to a flush toilet according to an embodiment of the invention. As shown in FIG. 7, the toilet assist member 40 is the same as conventional forms, so a detailed explanation thereof is here omitted, but this member is a package interior material constituting a portion of a packaging member fitted to the perimeter of the skirt portion 20 of the flush toilet apparatus 1 when the flush toilet apparatus 1 product is shipped, and is formed of cardboard or the like.

For example, prior to performing the work of installing the flush toilet apparatus 1 in a predetermined installation location, as shown in FIG. 7, the up-down direction midway portion M of the outer circumferential surface of the skirt portion 20, which has a larger cross section than the opening cross section of the bottom surface opening portion 40*a* of the toilet assist member 40, is held by the bottom surface opening portion 40*a* of the toilet assist member 40, by insertion into the bottom surface opening portion 40*a* of the toilet assist member 40 starting from the bottom part of the skirt portion 20 of the toilet body 2.

When installing a flush toilet apparatus 1 at a predetermined installation location, installers in front and back of the flush toilet apparatus 1 can easily carry the toilet assist member 40 and flush toilet apparatus 1 to a predetermined installation position by respectively grabbing onto pairs of front hand-hold portions 40*b* and rear hand-hold portions 40*c* on both sides of the toilet assist member 40 to lift and move the flush toilet apparatus 1.

Next, as shown in FIG. 1, the outer surface area A1 of the skirt portion 20 is set at 60% to 70% of the total surface area A3 (A3=A1+A2) of the outer surface area A2 of the toilet lid 6 and the outer surface area A1 of the skirt portion 20. The majority of parts other than the toilet lid 6 on the flush toilet apparatus 1 can thus be covered by the skirt portion 20, and the internal structures of the bowl portion 14 and the discharge trap pipe 18 of the toilet body 2, etc. can be projected by the skirt portion 20. Also, the skirt portion 20 of the toilet body 2 covering a majority of the flush toilet 1 can improve the external appearance of structural integration of the flush toilet 1, thus improving design characteristics.

Next, as shown in FIG. 3, the toilet seat 4 is disposed so as to cover from above the cover member 32 above the sanitary washing system functional portion 10 and the top surface 16*a* of the rim portion 16 of the toilet body 2. Thus with the toilet seat 4 in contact with the top surface 16*a* of the rim portion 16 on the toilet body 2, the toilet seat 4 can protect the top surface 16*a* of the rim portion 16, and the toilet seat 4, together with the cover member 32, can protect the top surface of the sanitary washing system functional portion 10.

Moreover, the top surface of the cover member 32 over the sanitary washing system functional portion 10 and the top surface 16*a* of the rim portion 16 can be hidden and made unobtrusive by the toilet seat 4, thereby improving design characteristics.

Next, as shown in FIG. 3, the toilet lid 6 is disposed to cover the entire toilet seat 4 from above. When the flush toilet apparatus 1 is not in use, the toilet seat 4 can normally be protected by covering the toilet seat 4 with the toilet lid 6. By covering the toilet seat 4 with the toilet lid 6, the toilet seat 4 and the interior of the bowl portion 14 of the toilet body 2 can be hidden and made unobtrusive, thereby improving design characteristics.

Also, as shown in FIG. 3, the toilet lid 6, mediated by the toilet seat 4 can, in addition to covering the bowl portion 14 of the toilet body 2 from above, simultaneously cover both the bowl portion 14 and the skirt portion 20 of the toilet body 2 through the toilet seat 4 by covering the skirt portion 20 from above, and can reliably protect the bowl portion 14 and the skirt portion 20, respectively, from above.

In addition, as shown in FIGS. 1 and 6, with the toilet lid 6 covering the skirt portion 20, the external appearance of structural integration of the skirt portion 20 and the toilet lid 6 can be improved, thereby improving design characteristics.

Figure 8:
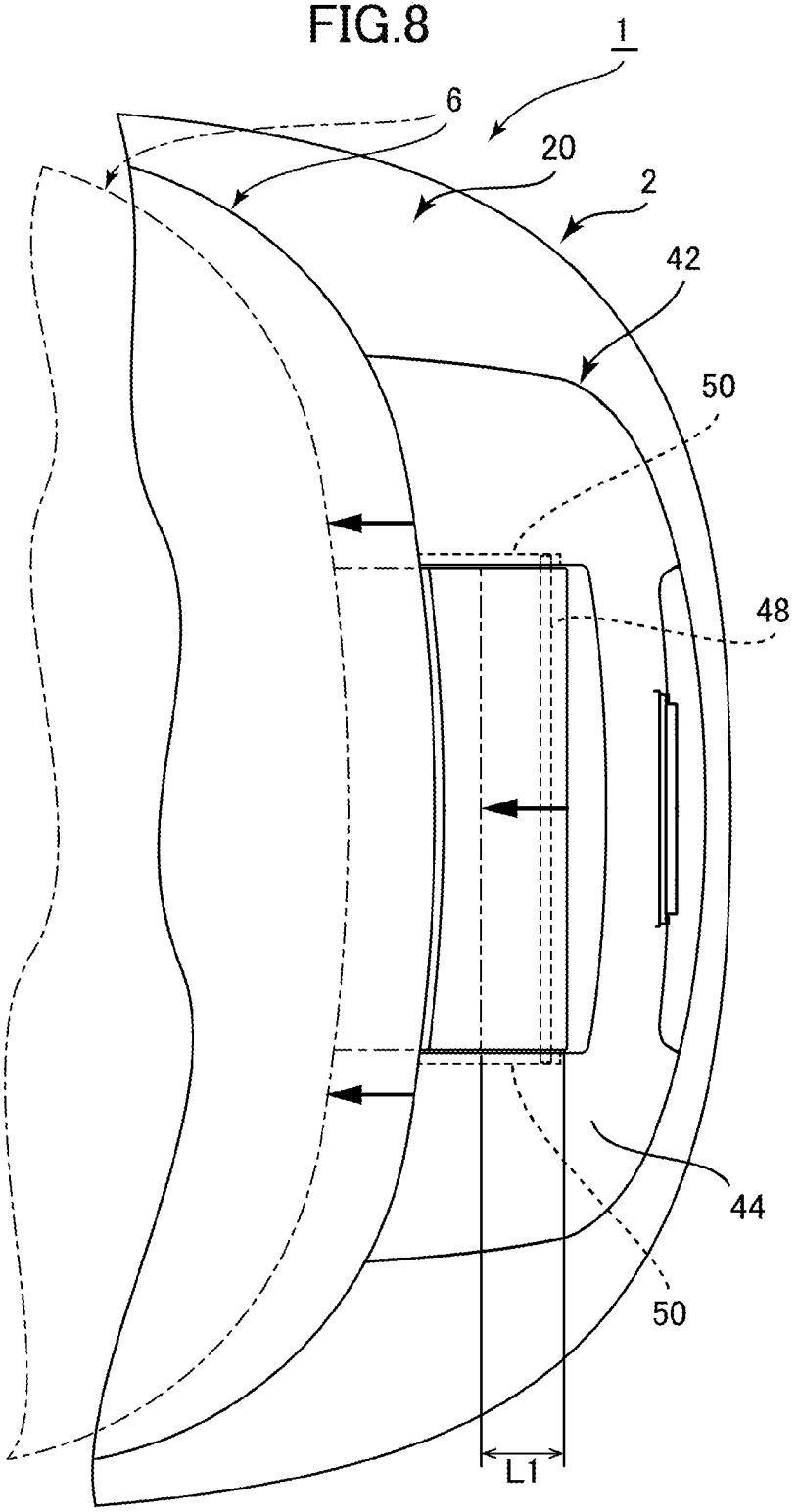
FIG. 8 is a partial expanded plan view showing an expansion of the rear part of the skirt portion and toilet lid of the toilet body in a flush toilet according to an embodiment of the present invention.

Next, FIG. 8 is a partial expanded plan view showing an expansion of the rear part of the skirt portion and toilet lid of the toilet body in a flush toilet according to an embodiment of the present invention.

As shown in FIGS. 3, 4, 6, and 8, the skirt portion 20 of the toilet body 2 forms a cut-away portion 42, cut out in an indentation, further back than the bowl portion 14 and the rim portion 16, and facing downward in the left-to-right direction midway portion at the upper top end portion.

Note that, as shown in FIG. 8, a cosmetic panel 44 is normally attached to the cut-away portion 42 in order to hide the interior of the cut-away portion 42, but FIGS. 3, 4, and 6 show the cut-away portion 42 with the cosmetic panel 44 removed.

Also, as shown in FIGS. 3, 4, 6, and 8, bearing frames 50, which serve as hinge portions, to which the rotation shafts 46 and 48 of the toilet seat 4 and the toilet lid 6 are respectively rotatably attached, are disposed inside the cut-away portion 42. Thus compared to the case in which each of the rotary pins 46, 48 of the toilet seat 4 and the toilet lid 6, and the bearing frames 50 serving as hinges thereof, are placed so as to be exposed to the outside of the cut-away portion 42 of the skirt portion 20, dirt can be made less prone to accumulate on the bearing frames 50 and on the rotary pins 46, 48 in the toilet seat 4 and toilet lid 6 surrounding them, thereby improving the functionality and cleanability of each rotary pin 46 and 48 in the toilet seat 4 and the toilet lid 6.

In addition, by the rotatable attachment of the toilet lid 6 rotary pin 48 to the bearing frames 50 inside the cut-away portion 42 of the skirt portion 20, with the toilet lid 6 covering the bowl portion 14 and the toilet seat 4, the external appearance of structural integration of the skirt portion 20 with the toilet lid 6 can be improved, thereby improving design characteristics.

Next, as shown in FIGS. 3, 4, 6, and 8, the bearing frames 50, together with the baseplate 52 disposed under the sanitary washing system functional portion 10 (see FIG. 6), are capable of sliding by just a predetermined distance L1 in the front-to-back direction (see FIG. 8) relative to the toilet body 2, and the positions in the front-to-back direction of the bearing frames 50 relative to the baseplate 52 in the skirt portion 20 of the toilet body 2, as well as the positions in the front-to-back direction of each rotary pin 46, 48 on the toilet seat 4 and the toilet lid 6, are adjustable.

Thus when installing the flush toilet apparatus 1 at an installation location, the positions in the front-to-back direction of the bearing frames 50, as well as the positions in the front-to-back direction of the rotary pins 46, 48 of the toilet seat 4 and toilet lid 6, can be appropriately adjusted and positioned, thereby reducing the burden of installation.

Next, as shown in FIG. 6, a ventilation duct 54 for ventilating the sanitary washing system functional portion 10 is disposed as part of the sanitary washing system functional portion 10 on the inside of the skirt portion 20 cut-away portion 42; and an illumination apparatus 56 or the like, which is part of the functional portion 8, is also disposed. Thus when installing or maintaining a part of the sanitary washing system functional portion 10 such as the ventilation duct 54, or a part of the functional portion 8 such as the illumination apparatus 56, part of the functional portion 8 can be easily accessed from the skirt portion 20 cut-away portion 42 by removing the cosmetic panel 44, thereby improving installation and maintenance characteristics.

Hereafter the operation of the flush toilet apparatus 1 in the above-described embodiment of the invention is explained.

First, according to the flush toilet apparatus 1 of the embodiment of the present invention, the side surface 20*a* of the skirt portion 20, which is further to the rear than the bowl portion 14 of the toilet body 2, projects further upward than the top surface 16*a* of the rim portion 16, so as to cover both sides in the left-to-right direction of the sanitary washing system functional portion 10, and is formed to taper inward. Thus, the gap between the side surface of the sanitary washing system functional portion 10 and the opposing inside surface of the skirt portion 20 is eliminated, and dirt from this gap can be prevented from adhering, thereby improving cleanability.

Also, the elimination of the gap between the side surface of the sanitary washing system functional portion 10 and the inside surface of the skirt portion 20 opposing it means that water can be prevented from intruding into the sanitary washing system functional portion 10 from the gap even when there is water on the outside of the skirt portion 20.

Furthermore, because the top-most surface 10*a* of the sanitary washing system functional portion 10 is disposed on the upper portion of the skirt portion 20, and the cover member 32 is removably attached to the top of the sanitary washing system functional portion 10 from above, access from above (the user side) to the sanitary washing system functional portion 10 is made easier when performing maintenance or the like on the washing device 30 of the sanitary washing system functional portion 10 or other equipment, for example, therefore maintenance characteristics can be improved.

By forming the side surface 20*a* of the skirt portion 20, which is further to the rear than the bowl portion 14, so that it projects further upward than the top surface 16*a* of the rim portion 16 so as to cover both sides in the left-to-right direction of the sanitary washing system functional portion 10, and so that it tapers inwardly, the external appearance of structural integration among the bowl portion 14, the rim portion 16, and skirt portion 20 can be raised, and design characteristics improved.

Next, according to the flush toilet apparatus 1 of the present embodiment, the placement of a seal member 34 between the bottom surface of the sanitary washing system functional portion 10 and the top surface 16*a* of the rear area of the rim portion 16. Thus even if, for example, flush water in the bowl portion 14 intrudes between the top surface 16*a* of the rear area of the rim portion 16 and the bottom surface of the sanitary washing system functional portion 10, the seal member 34 can prevent water from intruding into the sanitary washing system functional portion 10.

Next, according to the flush toilet apparatus 1 of the present embodiment, the top surface of the skirt portion 20 includes a horizontal portion 20*b* formed to be essentially horizontal, and a projecting portion 20*d*, projecting upward so as to cover the side of the sanitary washing device from the back end 20*c* of this horizontal portion 20*b*; the rim portion 16 bottom surface 16*b* is adhered to both the horizontal portion 20*b* and the projecting portion 20*d* on the top surface of the skirt portion 20 in the toilet body 2 manufacturing process. Thus, the rim portion 16 can be reliably affixed to the top surface of the skirt portion 20.

Since the adhered part of the rim portion 16 and the skirt portion 20 can be made unobtrusive, the appearance of structural integration between the rim portion 16 and the skirt portion 20 can be improved, as can design characteristics.

Next, according to the flush toilet apparatus 1 of the present embodiment, the rim spout port 22 is formed near the midway portion in the front-to-back direction of the inner circumferential surface of the rim portion 16, on one side in the left-to-right direction of the toilet body 2 (the right side in the left-to-right direction of the toilet body 2), the rim spout port 22 spouts flush water, directed to the rim spout port 22 through the water conduit 24 from a municipal water line (not shown) serving as water supply source, toward the rear. Further, the projecting portion 20*d* of the skirt portion 20 on both the left and right sides close to the top surface 16*a* of the rim portion 16 near the rim spout port 22, and further to the rear than this area, is formed to gradually project upward toward the rear, starting from an area close to the top surface 16*a* of the rim portion 16 near the rim spout port 22. Thus, when flush water W is spouted from the rim spout port 22 rearward, this spouted flush water W can be constrained from splashing outward in the rear area of the rim portion 16.

Next, according to the flush toilet apparatus 1 of the present embodiment, by setting the height position P1 of the top surface at the rear area R1 of the rim portion 16 at the same height position as the height position P3 of the top surface of the front area F1 of the rim portion 16, or at a height position higher than the height position P3 of the front area F1 of the rim portion 16, so that the nozzle body 38 tip portion 38*a* is not submerged near the same height position as the height position P2 of the top edge of the bowl portion 14. Thus, the nozzle body 38 of the nozzle apparatus 28 on the washing apparatus 30 in use can be made easier to extend to a predetermined position above the bowl portion 14, without the nozzle body 38 being submerged near the same height position as the height position P2 of the top edge of the bowl portion 14.

Also, a failure or malfunction of the washing device 30 caused by submersion in the bowl portion 14 of the nozzle body 38 on the nozzle apparatus 28 of the washing device 30 during use can be prevented.

Next, according to the flush toilet apparatus 1 of the present embodiment, the outer circumferential surface of the skirt portion 20 is formed in a downward tapering shape starting near the up-down direction midway portion M. Thus, a toilet assist member 40 for carrying the flush toilet apparatus 1 can be attached, for example, in the part where the outer circumferential surface of the skirt portion 20 has a tapered shape, thereby facilitating carrying of the flush toilet apparatus 1.

Next, according to the flush toilet apparatus 1 of the present embodiment, the toilet seat 4 is placed so that it covers from above the cover member 32 over the sanitary washing system functional portion 10 and the top surface 16*a* of the rim portion 16 of the toilet body 2. Thus, with the toilet seat 4 in contact with the top surface 16*a* of the rim portion 16 on the toilet main body 2, the toilet seat 4 can protect the top surface 16*a* of the rim portion 16.

The toilet seat 4, along with the cover member 32, can also protect the top surface of the sanitary washing system functional portion 10.

In addition, the top surface of the cover member 32 over the sanitary washing system functional portion 10 and the top surface 16*a* of the rim portion 16 can be hidden and made unobtrusive by the toilet seat 4, thereby improving design characteristics.

Next, according to the flush toilet apparatus 1 of the present embodiment, the toilet seat 4 can be protected by covering the toilet seat 4 with the toilet lid 6 when the flush toilet apparatus 1 is not in use, through mounting the toilet lid 6 so as to cover the entire toilet seat 4.

By covering the toilet seat 4 with the toilet lid 6, the toilet seat 4 and the interior of the bowl portion 14 of the toilet body 2 can be hidden and made unobtrusive, thereby improving design characteristics.

Next, according to the flush toilet apparatus 1 of the present embodiment, the majority of parts of the flush toilet apparatus 1 other than the toilet lid 6 can be covered by the skirt portion 20 by setting the surface area thereof to 60% to 70% of the total surface area A3 of both the outer surface area A2 of toilet lid 6 and the outer surface area A1 of the skirt portion 20 (A3=A1+A2). Thus, internal structures such as the bowl portion 14 and discharge trap pipe 18 of the toilet body 2 can be protected by the skirt portion 20.

Also, the skirt portion 20 of the toilet body 2 covering a majority of the flush toilet 1 can improve the external appearance of structural integration of the flush toilet 1, thus improving design characteristics.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet for discharging waste with flush water supplied from a water supply source, comprising:

a bowl portion;

a rim portion disposed on a top edge of the bowl portion;

a spout portion configured to spout flush water supplied from the water supply source to the bowl portion so as to form a circulating flow;

a discharge passage for discharging waste in the bowl portion, the discharge passage including an inlet portion being connected at the bottom of the bowl portion;

a sanitary washing device disposed at a rear of the bowl portion, the sanitary washing device including a nozzle which sprays the flush water toward a user positioned over the bowl portion; and a skirt portion configured to cover sides of both the bowl portion and the discharge passage;

wherein a side surface of the skirt portion extending towards the rear of the bowl portion includes a projecting area, the projecting area being configured to project further upward than a top surface of the rim portion so as to cover the sides of the sanitary washing device, and a top surface of the sanitary washing device is disposed on an upper portion of the projecting area of the skirt portion.

2. The flush toilet according to claim 1, wherein the flush toilet further comprises a seal member which is disposed between a bottom surface of the sanitary washing device and a top surface of a rear area of the rim portion.

3. The flush toilet according to claim 1, wherein a top surface of the skirt portion includes a horizontal portion formed essentially horizontally, and a projecting portion projecting upward so as to cover the side of the sanitary washing device from the back end of the horizontal portion; the rim portion is adhered to both the horizontal portion and the projecting portion on the top surface of the skirt portion.

4. The flush toilet according to claim 3, wherein the spout portion includes a spout port for spouting water rearward, the spout port being disposed near a midway portion in a front-to-back direction of the rim portion on one side in a left-to-right direction, and the projecting portion on the top surface of the skirt portion is configured to gradually project rearward from around the top surface of the rim portion near the spout port.

5. The flush toilet according to claim 1, wherein the skirt portion has an outer circumferential surface which is configured to taper downward from around a midway portion in the up-down direction of the skirt portion.

6. The flush toilet according to claim 1, wherein the flush toilet further comprises a toilet seat placed so as to cover the sanitary washing device and the rim portion from above.

7. The flush toilet according to claim 6, wherein the flush toilet further comprises a toilet lid disposed to cover an entire of the toilet seat from above.

8. The flush toilet according to claim 7, wherein the skirt portion has an outer surface area which is set at 60% to 70% of a total surface area of both outer surface areas of the toilet lid and the skirt portion.

9. A flush toilet for discharging waste with flush water supplied from a water supply source, comprising:

a bowl portion;

a rim portion disposed on a top edge of the bowl portion;

a spout portion configured to spout flush water supplied from the water supply source to the bowl portion so as to form a circulating flow;

a discharge passage for discharging waste in the bowl portion, the discharge passage including an inlet portion being connected at the bottom of the bowl portion;

a sanitary washing device disposed at a rear of the bowl portion, the sanitary washing device including a nozzle which sprays the flush water toward a user positioned over the bowl portion; and a skirt portion configured to cover sides of both the bowl portion and the discharge passage;

wherein the skirt portion is configured to project further upward than a top surface of the rim portion so that a side surface of the skirt portion extends toward the rear of the bowl portion to cover the sides of the sanitary washing device, and a top surface of the sanitary washing device is disposed on an upper portion of the skirt portion;

wherein the nozzle of the sanitary washing device is positioned above a rear of the rim portion at a standby state prior to use, and a front end of the nozzle extends up to a predetermined position above the bowl portion so as to spray the flush water in a predetermined direction when in use; and wherein a height position of the top surface of a rear area of the rim portion is either set to a same height position as the top surface of a front area of the rim portion, or is set to a height position higher than the same height position, so that the nozzle in use does not submerge at near the same height position as the height position of the top surface of the bowl portion.

* * * * *